US006848445B2

(12) United States Patent
Garofalo

(10) Patent No.: US 6,848,445 B2
(45) Date of Patent: Feb. 1, 2005

(54) REGULATOR FOR UNDERWATER BREATHING APPARATUS

(75) Inventor: Giovanni Garofalo, Rapallo (IT)

(73) Assignee: HTM Sport S.p.A. (IT)

( * ) Notice: Subject to any disclaimer, the term of this patent is extended or adjusted under 35 U.S.C. 154(b) by 0 days.

(21) Appl. No.: 10/095,438

(22) Filed: Mar. 13, 2002

(65) Prior Publication Data

US 2002/0134386 A1 Sep. 26, 2002

(30) Foreign Application Priority Data

Mar. 23, 2001 (IT) ..... GE2001A0028

(51) Int. Cl.[7] ..... A61M 16/00; A62B 9/02

(52) U.S. Cl. ..... 128/204.26; 128/205.24

(58) Field of Search ..... 128/204.18, 204.26, 128/201.27, 201.28, 205.24, 205.22, 207.14, 207.16; 251/89, 100, 111, 95, 96, 356, 359, 360; 137/484.2, 454.5, 505

(56) References Cited

U.S. PATENT DOCUMENTS 4,010,746 A * 3/1977 Pedersen ..... 128/204.26
4,041,977 A * 8/1977 Matsuno ..... 137/494
4,572,176 A * 2/1986 Walther ..... 128/204.26
5,233,976 A * 8/1993 Ferguson ..... 128/204.26
5,251,618 A * 10/1993 Christianson ..... 128/205.24
5,503,142 A * 4/1996 Semeia ..... 128/201.28
5,970,977 A * 10/1999 Sattelberg ..... 128/205.24
6,609,519 B2 * 8/2003 Pietrelli ..... 128/204.26
6,681,766 B1 * 1/2004 Matsuoka ..... 128/201.27
6,715,488 B1 * 4/2004 Matsuoka ..... 128/204.26
6,718,976 B1 * 4/2004 Matsuoka ..... 128/204.26
6,718,977 B1 * 4/2004 Matsuoka ..... 128/204.26

OTHER PUBLICATIONS

Cited Ref. Re'd @Apr. 16, 2003.*

* cited by examiner

*Primary Examiner*—Henry Bennett
*Assistant Examiner*—Teena Mitchell
(74) *Attorney, Agent, or Firm*—Marvin Petry; Stites & Harbison PLLC

(57) ABSTRACT

Regulator for underwater breathing apparatus including: a box-like body having a mouthpiece; and air inlet ducts connected to said box-like body through an inlet valve; one or more exhaust duct connected to the box-like body; a flexible diaphragm frontally positioned on the opposite side as to the mouthpiece and co-operating with an opening or closing lever of the inlet valve, the regulator includes a manually operable limiting device operable from the outside and movable from a first position, where it allows limited movement of the lever inside of the box-like body, to a second position where it allows unlimited movement of the lever inside of the box-like body.

9 Claims, 1 Drawing Sheet

REGULATOR FOR UNDERWATER BREATHING APPARATUS

FIELD OF THE INVENTION

The present invention refers to the regulators for underwater breathing apparatus.

As is known, said regulators include a flexible diaphragm which, through the difference in pressure which is generated between the chamber of the regulator and the outer environment whenever the diver inhales, operates a lever coupled in well known manner to the valve controlling the air flow from the compressed air source. It happens that during the phase of entry of the diver into the water, for instance with a backward dive from a boat, it is possible that the diaphragm will be subjected to an excessive flexion due to the sudden pressure increase caused by the impact with the water, which in turn causes an excessive movement of the lever coupled to the valve controlling the air flow, giving rise to undesired self-delivery effects.

SUMMARY OF THE INVENTION

It is therefore the main object of the present invention to obviate to the drawbacks of the known regulators by providing the regulators with a manually operable device which may be operated from a first operational position in which it is capable of preventing, when the diver enters the water, the excessive shifting of the lever associated with the valve controlling the air flow and which, when the diver is underwater, may be shifted to a second operational position in which it allows the lever to perform its normal function of controlling the compressed air inlet duct.

According to the present invention said object is obtained by providing a regulator for an underwater breathing apparatus of the kind comprising a box-like body having a first and end a second end; a chamber in said body, the chamber containing a regulating device for regulating the flow of air; a mouthpiece tube connected to the first end of the body and carrying a mouthpiece; an air inlet hose connected to the body by means of an air inlet valve, the valve being controlled by the regulating device; a diaphragm for actuating the regulating device when a user inhales, at least on exhaust hose connected to the body; and means manually operable from the outside and movable from a first position, in which it limits the movement of the regulating device, to a second position in which it allows the unlimited movement of the regulating device.

BRIEF DESCRIPTION OF THE DRAWINGS

Further objects and advantages of the present invention will be better understood from the following description, made with reference to the enclosed drawing, in which.

DETAILED DESCRIPTION OF THE PREFERRED EMBODIMENTS

Figure 1:
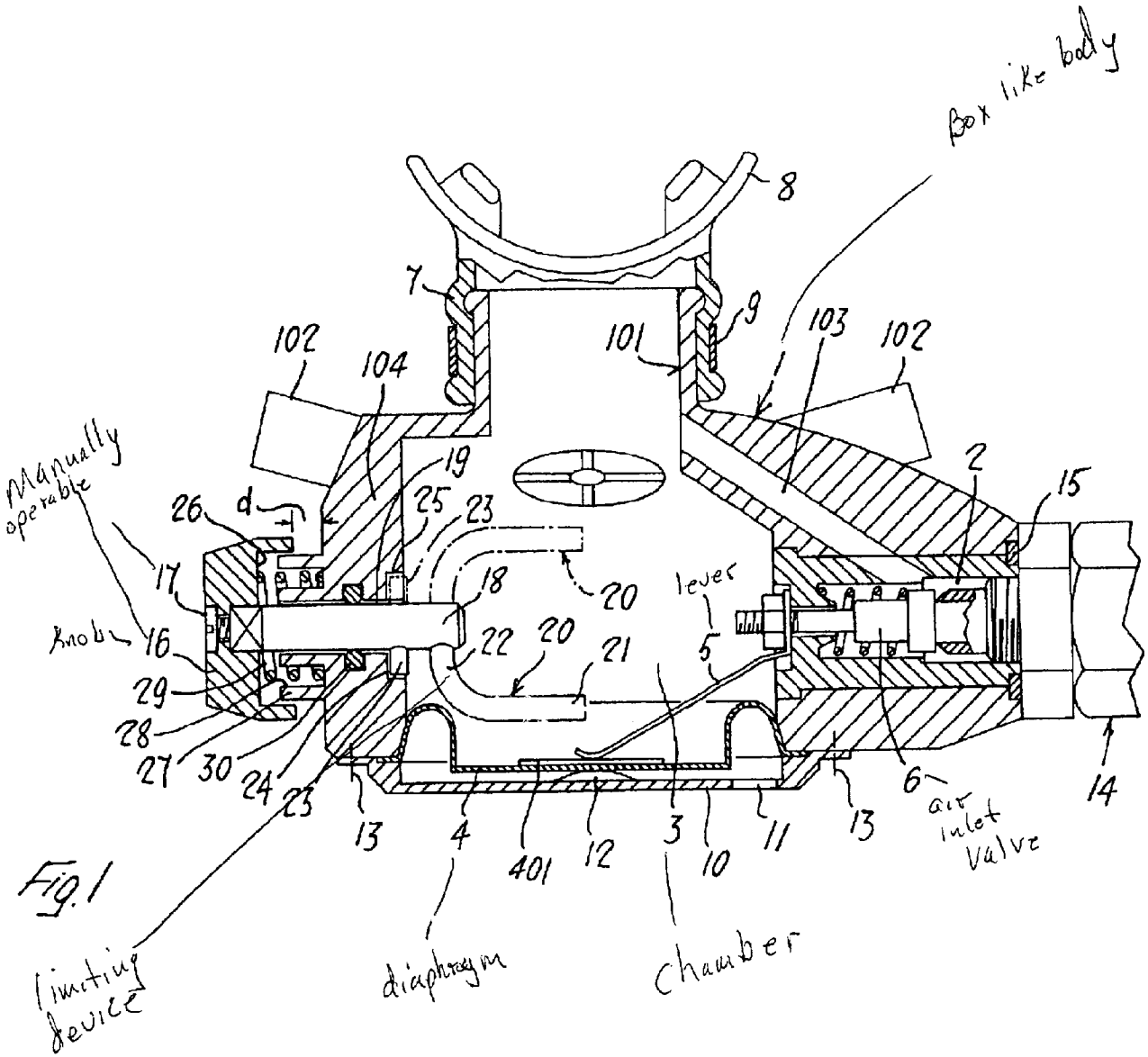
FIG. 1 is a partially sectioned top plan view of a preferred embodiment of a regulator for underwater breathing apparatus according to the present invention.

In FIG. 1 a regulator for underwater breathing apparatus is shown comprising a box-like body 1 housing a device (3, 4, 5, 6) for the regulation of the air flow coming from an inlet duct 2. The regulating device essentially consists of a chamber 3 having a flexible diaphragm 4 located at the end of the box-like body 1 opposite to the end with the mouthpiece 8; the flexible diaphragm 4. Upon a difference of pressure which is created when the diver inhales, diaphragm 4 operates the lever 5 coupled to the air flow adjustment valve 6, so that the valve 6 opens the inlet duct 2. The duct 2 is connected through a joint 14 to a compressed air source, as for instance compressed air bottles (not shown), the connection being provided with a sealing means 15. The box-like body 1 includes moreover an integral pipe 101 connected by joint 7 to the mouthpiece 8, the joint 7 being advantageously made of elastomeric material and provided with a sealing ring 9 for the regulator. The box-like body 1 includes moreover two exhaust ducts 102, positioned sideways relative to the diver's mouthpiece 8, and a by-pass pipe 103 integral with the box-like body 1. The regulator includes moreover a hard cap 10 in connection with the flexible diaphragm 4. The cap 10 is provided with an opening 11 for the communication of the diaphragm 4 with the surrounding water. In the present embodiment the cap 10 is fastened through pins 13 to the box-like body 1 and the flexible diaphragm 4 which is inserted at its ends between the box-like body 1 and the cap 10, assuring an effective sealing of the breathing device. Moreover as is know, a button 12 is provided for the discharging and control of the regulator.

On a side wall 104 of the box-like body 1 near the place where the diaphragm 4 is housed, in this case it is the wall opposite to the compressed air inlet duct 2, there is provided a limiting device for limiting the movement of the lever 5 toward the inside of the chamber 3. This device includes a knob 16 connected through a screw 17 to an end of a spindle 18 housed within a through hole 19 formed on the side wall 104 of the regulator. The other end of the spindle 18 extends within the regulator chamber 3 and to the end a substantially "L" shaped element formed by a base 21 parallel and spaced from the spindle 18 and by a shank 22 orthogonal to said spindle 18. Near the "L" shaped element 20, in a direction perpendicular to the axis of the spindle 18, a pin 23 is secured to the spindle 18. The pin 23 may be accomodated in one of two diametrically opposed seats 24 and 25 formed on the inner side wall 104 of the regulator. As mentioned, the spindle 18 has an end extending outside of the regulator to which is connected a knob 16. The knob 16 is internally provided with a cylindrical seat 26 coupled to a cylindrical pin 27 projecting outward from the side wall 104. The cylindrical pin 27 has an axial annular groove 28 in which is inserted one end of a compressed spring 29, whose other end is fastened in the bottom wall of the cylindrical seat 26 of the knob 16. Moreover, in order to guarantee the watertight sealing of the above described limiting device, there is provided a sealing ring 30 inserted between the spindle 18 and the inner wall of the through hole 19.

The operation of the limiting device is as follows: normally the "L" shaped element 20 is in an inactive position, which is the position shown with the dotted line in FIG. 1, with the pin 23 inserted within the upper seat 25, in which position the lever 5 is free to move to the inside of the chamber 3 and co-operate with the valve 6 for the opening of the air inlet duct 2. When the diver is going to dive into the water, to prevent the lever 5 from shifting, which would cause unwanted self-supplying effects, the diver makes the spindle 18 rotate so that the "L" shaped element 20 places the base 21 next to the end of the lever 5, which is the active, or first, position. To do so, diver takes the knob 16 and pushes the spindle 18 to the inside, against the force of the spring 29, so to make the spindle move the distance d, necessary to release the pin 23 from the seat 25. At this point, by rotating the knob 16 to the lower part of FIG. 1, it is possible to move the pin 23 next to the other seat 24, into which the pin will be withdrawn under the force of the return force of the spring 29. In this way the movement of the lever 5 to the inside of the chamber is limited by contact of the end of said lever 5 against the base 21 of the "L" shaped element correctly positioned in active position. When the diver has entered the water, to restore the normal functioning of the regulator, he has just to perform with the knob 16 and operation opposite to the one just described, moving the "L" shaped element 20 back to the inactive, or second, position shown by the dotted line.

What is claimed is:

1. A regulator for an underwater breathing apparatus comprising:

a box-like body having a first end and a second end;

a chamber in said body, said chamber containing a mouthpiece tube connected to the chamber, an air inlet valve, and a lever operatively associated with the air inlet valve for controlling the inflow of air through an air inlet;

a diaphragm cooperating with an end of said lever for actuating said lever when a user inhales; and a limiting device manually operable from the outside of the box-like body and movable between a first position, in which it allows limited movement of said lever, to a second position in which it allows unlimited movement of said lever.

2. The regulator according to claim 1, in which the said limiting device comprises a spindle bearing at one end, inside of the chamber, an L shaped element and provided at its other end outside of said chamber with a handgrip element, and in which in said box-like body is provided with a hole through which the said spindle is rotatably and axially shiftably mounted.

3. The regulator according to claim 2, wherein said L shaped element of the said limiting device comprises a base element substantially parallel to said spindle and a shaft substantially orthogonal to said spindle, said base element being able to co-operate with said lever so as to be closer to the lever in the said first position then it is in the said second position, so as to limit the movement of the lever in the said first position.

4. The regulator according to claim 3, in which said spindle is formed with a pin extending at right angles with respect to said spindle axis and in which in the inner side wall of the said box-like body are formed at least two seats which accomodate said pin, one of said seats accomodating the pin in the first position of the said L shaped element, and the other of said seats accomodating the pin in the second position of said L shaped element.

5. The regulator according to claim 4, further comprising spring means for returning said pin into one of said seats.

6. The regulator according to claim 3, in which the handgrip comprises a knob which is fastened to the end of said spindle located outside of the said box-like body, for axially shifting and/or rotating the spindle.

7. The regulator according to claim 6, in which said knob is provided, on the side facing the regulator side wall, with a cylindrical seat in which a cylindrical pin projecting out of said side wall is inserted, said cylindrical pin being provided with at least one groove in which one end of said spring means is inserted, the other end of the spring being fastened to the bottom wall of said cylindrical seat of said knob.

8. The regulator according to claim 2, in which said knob is removably fastened to said spindle.

9. The regulator according to claim 2, in which a sealing ring is provided between said spindle and the inner wall of said hole.

* * * * *